US005782229A

United States Patent [19]

Evans et al.

[11] Patent Number: 5,782,229

[45] Date of Patent: Jul. 21, 1998

[54] SINGLE CAM COMPOUND BOW WITH INTERCHANGEABLE CAMS FOR VARYING DRAW LENGTH

[76] Inventors: John D. Evans, Box 55052 #18, 7196 Temple Dr. NE., Calgary, Alberta, Canada, T1Y 4E0; Scott Phillips, #5 - 1246 Fairfield Rd., Victoria, British Columbia, Canada, V8V 3B5

[21] Appl. No.: 803,825

[22] Filed: Feb. 24, 1997

Related U.S. Application Data

[63] Continuation-in-part of Ser. No. 514,874, Aug. 14, 1995, abandoned.

[30] Foreign Application Priority Data

Aug. 14, 1996 [CA] Canada ..... 2183305

[51] Int. Cl.[6] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 3,486,495 | 12/1969 | Allen . | |
| 3,958,551 | 5/1976 | Ketchum . | |
| 3,987,777 | 10/1976 | Darlington . | |
| 4,060,066 | 11/1977 | Kudlacek . | |
| 4,079,723 | 3/1978 | Darlington . | |
| 4,112,909 | 9/1978 | Caldwell . | |
| 4,300,521 | 11/1981 | Schmitt . | |
| 4,365,611 | 12/1982 | Nishioka . | |
| 4,461,267 | 7/1984 | Simonds et al. | 124/25.6 |
| 4,512,326 | 4/1985 | Jarrett . | |
| 4,515,142 | 5/1985 | Nurney | 124/25.6 |
| 4,519,374 | 5/1985 | Miller | 124/25.6 |
| 4,562,824 | 1/1986 | Jennings . | |
| 4,774,927 | 10/1988 | Larson | 124/25.6 |
| 4,838,236 | 6/1989 | Kudlacek | 124/25.6 |
| 4,926,833 | 5/1990 | Darlington | 124/25.6 X |
| 4,967,721 | 11/1990 | Larson | 124/25.6 |
| 5,368,006 | 11/1994 | McPherson | 124/25.6 |
| 5,505,185 | 4/1996 | Miller | 124/25.6 |

*Primary Examiner*—John A. Ricci
*Attorney, Agent, or Firm*—Oyen Wiggs Green & Mutala

[57] ABSTRACT

A cam assembly for a single cam bow provides replaceable cable sheaves. By selecting different cable sheaves the draw length of the bow may be altered while the bow is strung. The draw length can be further fine tuned by providing differentially spaced positions for attaching either end of the bow string to the cam assembly. A bow equipped with a cam assembly according to the invention can have a draw length adjustable in fine increments over a range of several inches.

23 Claims, 11 Drawing Sheets

SINGLE CAM COMPOUND BOW WITH INTERCHANGEABLE CAMS FOR VARYING DRAW LENGTH

This application is a continuation in part of application Ser. No. 08/514,874, filed Aug. 14, 1995, now abandoned.

FIELD OF THE INVENTION

This invention relates to compound archery bows. In particular, the invention relates to single cam type compound archery bows.

BACKGROUND OF THE INVENTION

Bows have been used for hunting and target shooting for ages.

To be most useful a bow should shoot straight, impart the maximum energy to an arrow and have draw characteristics that allow an archer to draw and release an arrow in a controlled manner. Modem bows are highly refined instruments. Small deviations in performance characteristics can make the difference between a very good bow and a bow that is not acceptable to a discerning archer.

McPherson, U.S. Pat. No. 5,368,006 describes a single cam type compound archery bow. This bow has achieved reasonably wide acceptance. However, the McPherson bow has several drawbacks. One problem with the McPherson bow is that it does not provide a simple means for accurately adjusting the draw length. The bow must be dismantled and the cam assembly replaced to change the bow's draw length. Another problem with the McPherson bow is that, when an arrow is released, the nock of the arrow moves along a path that deviates substantially from a straight line. This causes the McPherson bow to be less accurate than is desirable.

SUMMARY OF THE INVENTION

The invention provides a compound bow. The compound bow has a handle; upper and lower flexible limbs having inner ends connected to opposite ends of the handle; a cam assembly pivotally mounted at an outer end of one of the limbs; and a pulley pivotally mounted at an outer end of a second one of the limbs. The cam assembly has first and second parallel bow-string sheaves; and, a removable cable sheave parallel to and fixed to the bow-string sheaves. A bow string extends from a first attachment point on the cam assembly, around a peripheral portion of the first bow string sheave, around the pulley, and around a peripheral portion of the second bow string sheave to a second attachment point on the cam assembly. A cable extends from an attachment point near the outer end of the second one of the limbs around a peripheral portion of the cable sheave to a third attachment point on the cam.

In a preferred embodiment the cable sheave is sandwiched between the first bow-string sheave (or "collector sheave") and the second bow-string sheave (or "main sheave").

Most preferably the positions of the first and second attachment points are both adjustable in differently sized increments to provide differential fine adjustment to the bow's draw length.

A second aspect of the invention provides a compound bow kit comprising: a handle; upper and lower flexible limbs having inner ends connected to opposite ends of the handle; a cam assembly pivotally mounted at an outer end of one of the limbs, the cam assembly having: (1) first and second parallel bow-string sheaves; and, (2) a set of a plurality of removable cable sheaves in graduated sizes, each of the modular cable sheaves capable of attachment to the bow-string sheaves; and, a pulley pivotally mounted at an outer end of a second one of the limbs. A bow string extends from a first attachment means on the cam assembly, around a peripheral portion of the first bow string sheave, around the pulley, and around a peripheral portion of the second bow string sheave to a second attachment means on the cam assembly. The second attachment means has a plurality of alternative positions. A cable extends from an attachment point near the outer end of the second one of the limbs around a peripheral portion of the cable sheave to a third attachment means on the cam assembly. The draw length of the bow is adjustable to one of a plurality of fixed draw lengths by selecting and attaching one of the plurality of removable modular cable sheaves to the bow-string sheaves. The draw length of the bow is adjustable to a draw length intermediate two of the plurality of fixed draw lengths by selecting one of the alternative positions for the second attachment means.

Most preferably the positions of the first and second attachment points are both adjustable in differently sized increments to provide fine adjustment to the bow's draw length.

BRIEF DESCRIPTION OF THE DRAWINGS

In drawings which illustrate non-limiting preferred embodiments of the invention.

DETAILED DESCRIPTION OF THE PREFERRED EMBODIMENT

Figure 1:
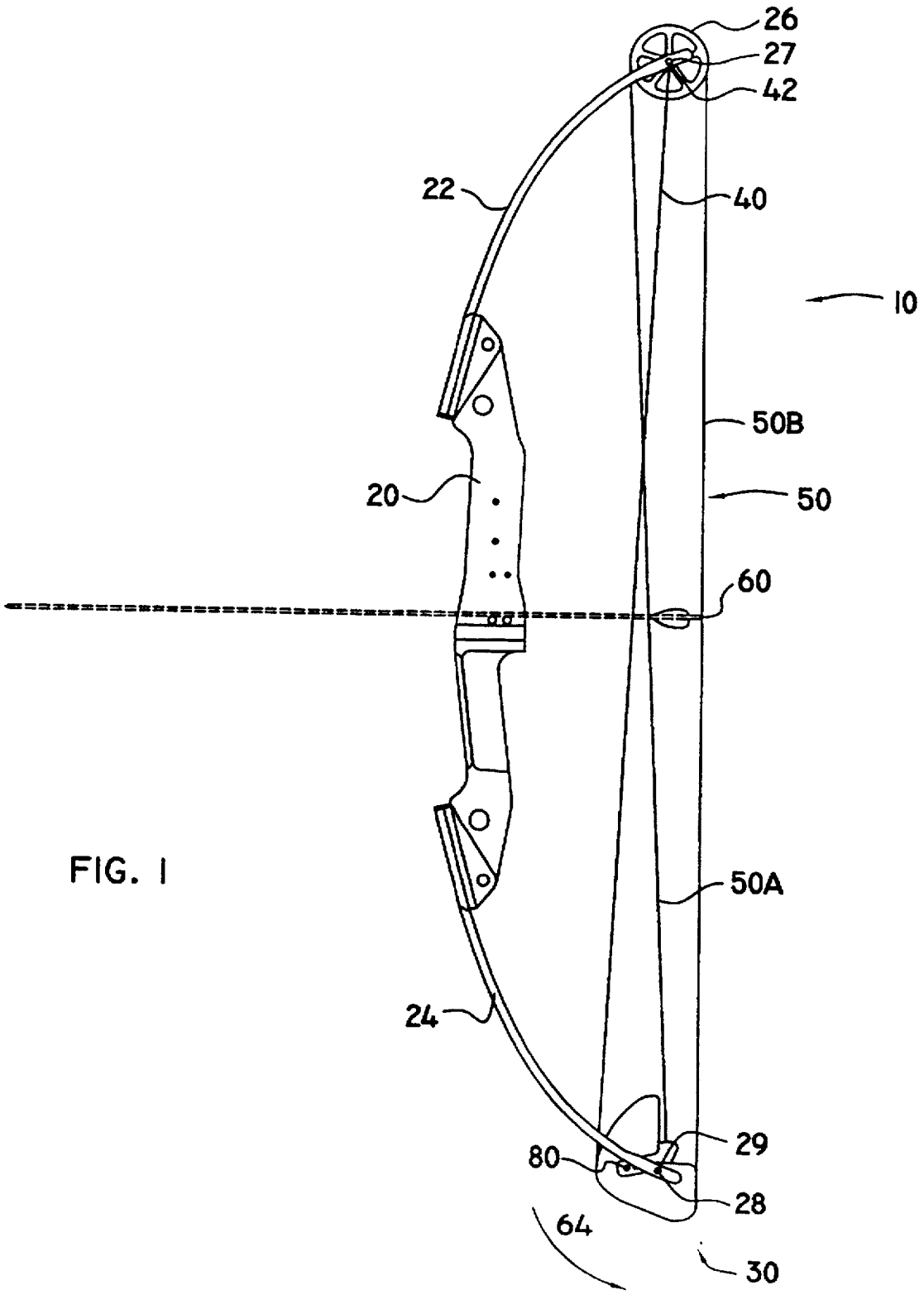
FIG. 1 is an elevational schematic view of a single cam compound bow according to the invention.

As shown in FIGS. 1 to 5, a bow 10 has a handle portion 20 to which are attached first and second resiliently deformable limbs 22, 24. Limb 22 is adapted to receive a pulley 26 at its outer end. Pulley 26 is free to rotate about axis 27.

Limb 24 is adapted to pivotally receive a cam assembly 30 at its outer end. Cam assembly 30 is mounted on an axle 28 and pivots about an axis 29. Limbs 22 and 24 are preferably adjustably and removably mounted to handle 20 so that the force required to draw bow 10 (the "draw weight") can be changed by adjusting the angles at which limbs 22 and 24 extend from handle 20 and/or by selecting limbs 22 and 24 which have a desired degree of rigidity.

Cam assembly 30 comprises three parallel sheaves (see FIG. 4), a cable sheave 30A, a collector sheave 30B, and a main sheave 30C. Each sheave of cam assembly 30 comprises a body having a peripheral profile, as described below, and a groove (sheaves 30A, 30B, and 30C, comprise grooves 31A, 31B, and 31C respectively) extending around the peripheral profile. Grooves 31A, 31B, and 31C are preferably parallel to each other when cam assembly 30 is viewed edge-on.

A cable 40 extends from an attachment point 42 near the outer end of limb 22 to cable sheave 30A on cam assembly 30. Cable 40 first contacts cable sheave 30A at a tangent point 43 and extends around cable sheave 30A in groove 31A to an attachment point 44 on cam assembly 30. The position of attachment point 44 is preferably adjustable to fine-tune the performance characteristics of bow 10. This may be accomplished by providing several fixed posts on cam assembly 30 at spaced locations which can serve as alternate attachment points 44, providing holes at spaced locations for connecting a movable attachment point 44 by means of bolts, screws, pins or other acceptable fastening means, or by providing an attachment point 44 on a base which can be moved and clamped in a desired position. Preferably several fixed posts are provided on cam assembly 30 for anchoring one end of cable 40 to cam assembly 30 as this is simpler than the other possibilities discussed above. The position of attachment point 42 may also be adjustable.

A bowstring 50 has a first portion 50A extending from an attachment point 52 on cam assembly 30 around groove 31B of collector sheave 30B. Bowstring 50 leaves collector sheave 30B at a tangent point 53. First portion 50A of bowstring 50 extends from tangent point 53 to pulley 26. A second portion 50B of bowstring 50 continues from first portion 50A, around pulley 26, to cam assembly 30. Second portion 50B contacts main sheave 30C at a tangent point 55 and extends around groove 31C in main sheave 30C to an attachment point 54 (see FIG. 3) on cam assembly 30.

Tangent point 43 of cable 40 is on the opposite side of cam assembly 30 from the tangent points 53, 55 of bowstring portions 50A and 50B. When bowstring portion 50B is drawn rearwardly at nock point 60 to nock an arrow (shown in dashed outline) then cam assembly 30 rotates in the direction indicated by arrow 64. As cam assembly 30 rotates, cable 40 is wound onto cable sheave 30A thereby drawing the outer ends of limbs 22 and 24 together. At the same time, bowstring 50 is fed out by collector sheave 30B and main sheave 30C. As cam assembly 30 rotates, the positions of tangent points 43, 53 and 55 move relative to the center of cam assembly 30. The radial distances of tangent points 43, 53 and 55 from axis 29 are determined by the profiles of sheaves 30A, 30B, and 30C. The angles of tangent points 43, 53 and 55 relative to bow 10 also change as bowstring 50 is drawn and cam assembly 30 rotates.

Preferably cable sheave 30A is located between collector sheave 30B and main sheave 30C. The forces acting on cable sheave 30A are generally much larger than on the forces acting on either of the other two sheaves. While the tension in bow string 50, which acts on collector sheave 30B and main sheave 30C, typically reaches tensions on the order of about 60 pounds, cable 40 typically experiences tensions of 250 pounds or more. Thus it is desirable to place cable sheave 30A between sheaves 30B and 30C to minimize any net twisting moment on cam assembly 30 which would tend to twist lower limb 24. If limb 24 is caused to twist unduly then the material of limb 24 may crack.

If collector sheave 30B and main sheave 30C are adjacent to each other, which is not preferred, then collector sheave 30B and main sheave 30C may be made integral with each other. Positioning cable sheave 30A on the outside of cam assembly 30 can facilitate interchanging cable sheave 30A to adjust the draw length of bow 10 as discussed below.

Figure 8:
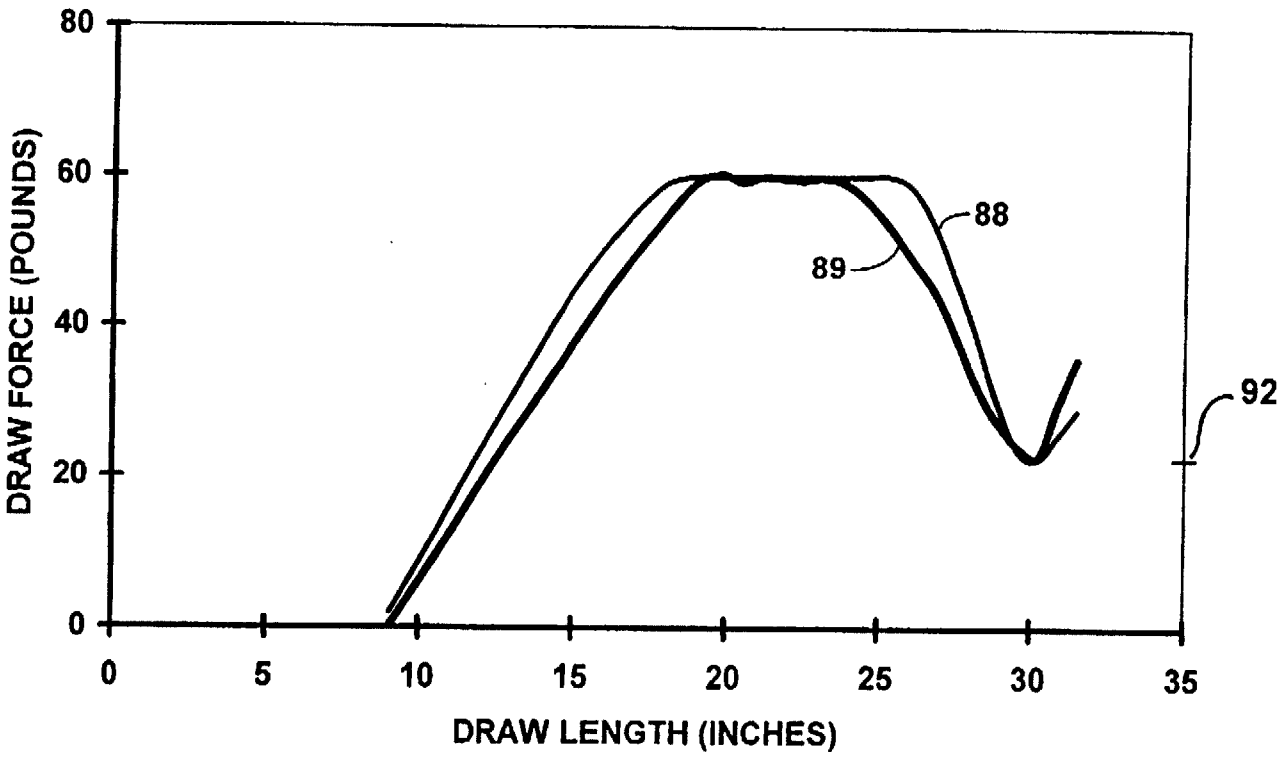
FIG. 8 is a plot of force vs. draw distance for the cams shown in FIGS. 5A and 5B and for an ideal cam.
Figure 9B:
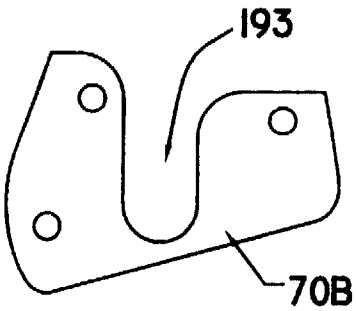
FIGS. 9A, 9B, 9C, and 9D show a series of cable sheaves for use in the cam assembly of the invention to yield different draw lengths.
Figure 9D:
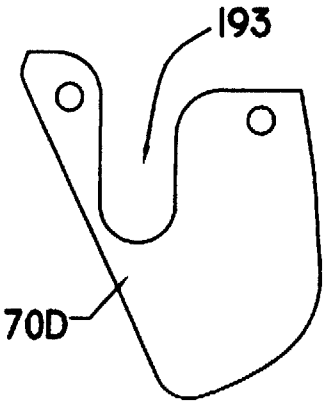
Figure 9A:
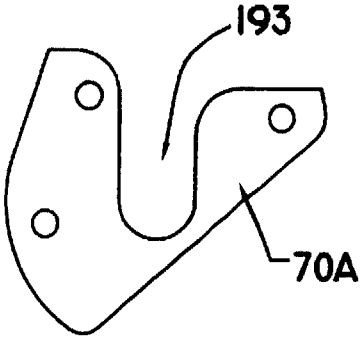
Figure 9C:
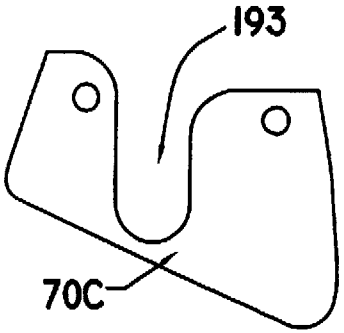

An important challenge in designing a single cam bow is to provide sheaves 30A, 30B, and 30C, which will cause a bow 10 to have a force curve as close to the ideal force curve shown in FIG. 8 as possible while simultaneously providing a nock point 60 which travels in a straight line as an arrow is released from bow 10. If nock point 60 deviates from a straight line as an arrow is released then the arrow may be launched so that its axis does not exactly coincide with the arrow's trajectory. This slows the arrow and reduces the accuracy with which the arrow can be placed.

The force required to hold nock point 60 at a given position (the "draw force") varies depending upon how far nock point 60 is pulled back from its undrawn position. Most preferably (see the "ideal" curve 88 of FIG. 8), as bow 10 is drawn, the draw force should quickly rise to a maximum value and retain this maximum value until nock point 60 approaches the draw length of bow 10. The draw force should then drop off quickly as nock point 60 nears the desired draw length to a value 92 at the desired draw length (point 89) substantially less than the maximum draw force. This reduction in force is called "let-off". Let off is provided primarily by designing cable sheave 30A so that, when nock point 60 is at a desired draw length for bow 10, the radius of cable sheave 30A at tangent point 43 is small.

Figure 2B:
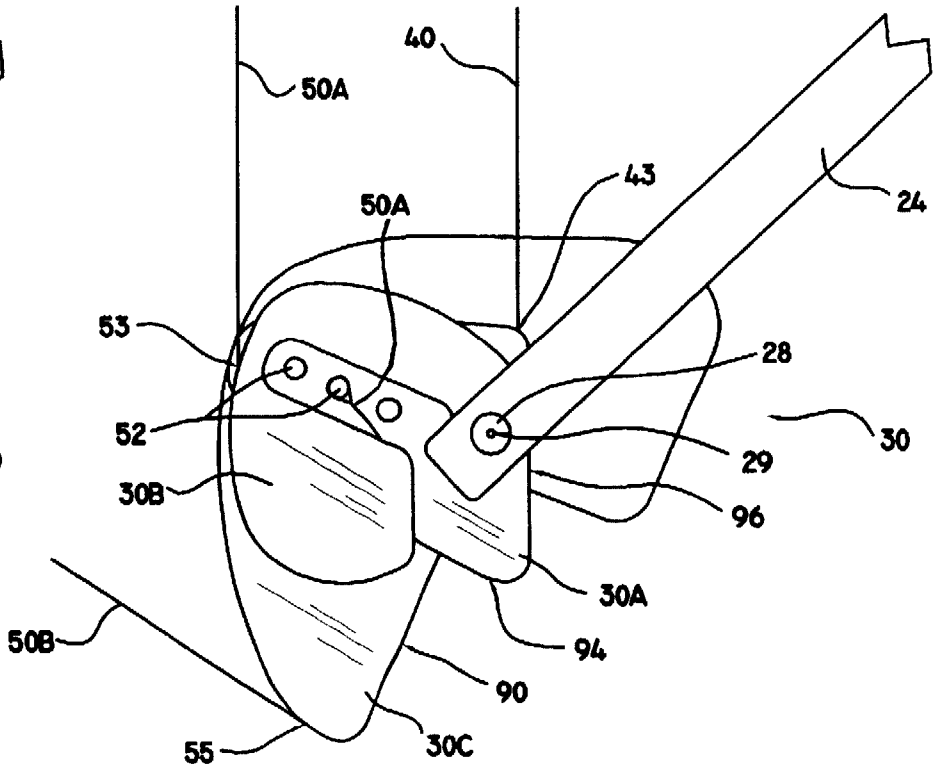
FIG. 2A is a detailed view of the cam assembly thereof in an undrawn position and FIG. 2B is a detailed view of the cam assembly thereof in a fully drawn position.
Figure 2A:
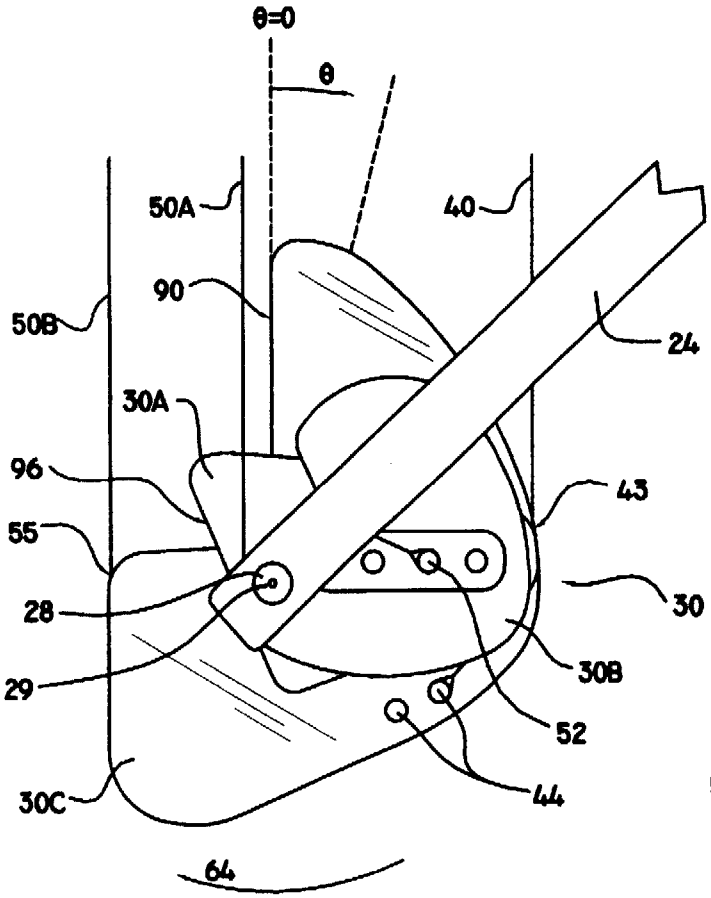

As shown in FIG. 2A, when bow 10 is viewed with handle 20 on the right, both sections 50A and 50B of bow string 50 provide a clockwise moment on cam assembly 30 about axis 29. This moment is balanced by a counterclockwise moment created by the cable 40. As bow 10 is drawn, these forces can be considered to be in static equilibrium. It is clear that a change in the profile of any one of sheaves 30A, 30B or 30C would change the tension in bow string 50 which, in turn, would change the draw force.

The draw force required to draw nock point 60 rearwardly depends on the tension in bow string 50 and the angle made by bowstring 50 at nock point 60. The tension in bow string 50 depends, in turn, on the tension in cable 40, the radii of sheaves 30A, 30B, and 30C, at the tangent points 43, 53 and 55 where the ends of bow string 50 and cable 40 make contact with cam assembly 30, and the forces exerted by bow limbs 22, 24 on cam assembly 30 and pulley 26. The forces exerted by limbs 22, 24 depend on the amount that limbs 22, 24 are flexed and on the elasticity modulus of limbs 22, 24.

In general, main sheave 30C and collector sheave 30B work together. A small change in the profile of either one of these sheaves will have a relatively small effect on the draw force curve. The cable sheave 30A is relatively small and works alone to oppose the other two sheaves.

The draw force depends in large part upon the profile of cable sheave 30A. A relatively small change in the profile of cable sheave 30A has a relatively large effect on the draw force curve. If tangent point 43 is close to axis 29 then cable sheave 30A provides a high mechanical advantage and the draw force is reduced. If tangent point 43 is farther from axis 29 then the draw force is increased.

The profiles of sheaves 30A, 30B and 30C also affect the path taken by nock point 60 when an arrow is released. Assuming that each of limbs 22 and 24 bends equally as bow 10 is drawn, nock point 60 will travel in a line which is approximately straight if bow string 50 feeds out from the ends of each of limbs 22 and 24 toward nock point 60 at identical rates. However, the fact that the tangent point 55 at which the bow string 50 leaves main sheave 30C moves, both in its distance from the axis 29 and in its angle must also be taken into account to provide truly flat travel of nock 60. More specifically, the rate at which bow string 50 is fed out toward nock point 60 around idler pulley 26 depends on the vertical feedout from collector sheave 30B (which in turn depends on the radius of sheave 30B at tangent point 53 and the current position of tangent point 53) and on the amount that the ends of limbs 22 and 24 have been pulled together, primarily by the action of cable 40 and cable sheave 30A.

In most cases, increasing the radius of main sheave 30C tends to raise nock point 60 while increasing the radius of either of the other two sheaves 30A and/or 30B tends to lower the position of nock point 60.

The shapes of the three sheaves of cam assembly 30 cooperate to provide the desired variation in draw force as bow 10 is drawn. The shapes of collector sheave 30B and main sheave 30C cooperate to ensure that nock 60 moves linearly after bowstring 50 is released. After bowstring 50 is released, cam assembly 30 begins to rotate in a direction opposite to arrow 64. Collector sheave pulls bowstring 50 over pulley 26 at the same rate that main sheave 30C takes in bowstring 50 from below nock 60.

Figure 6:
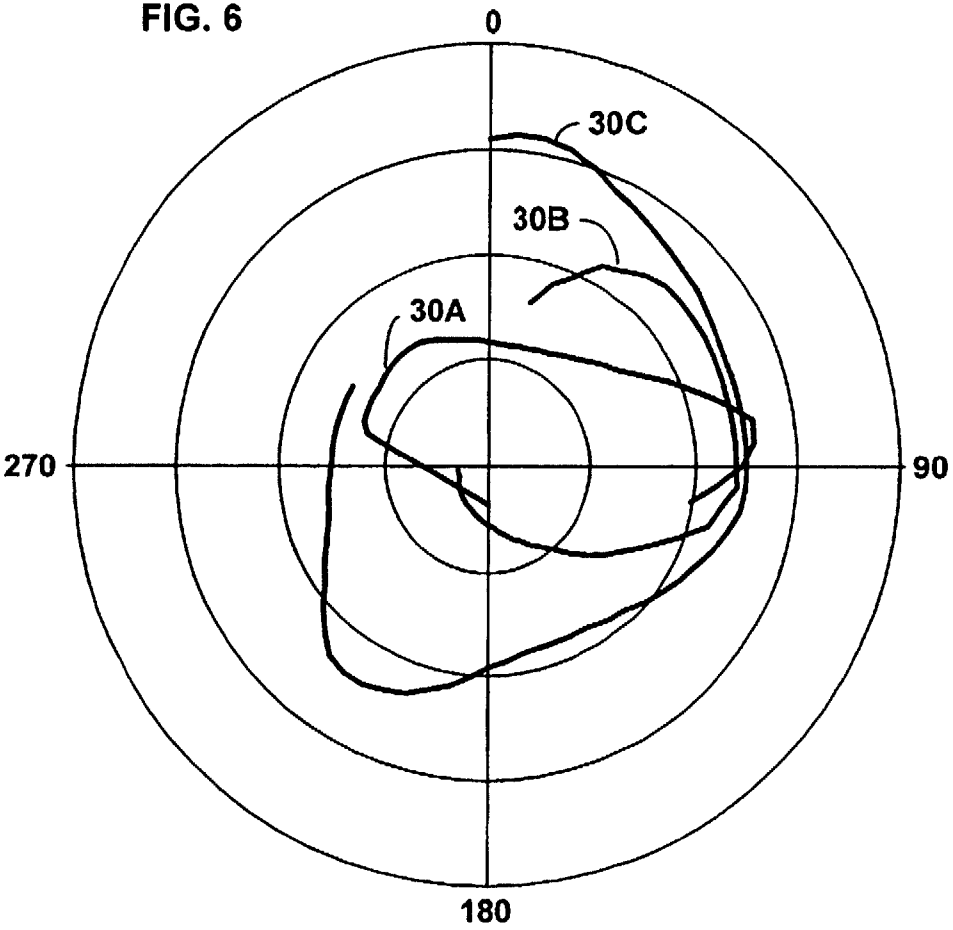
FIG. 6 is a radar plot showing the shape of sheaves for a cam assembly according to a preferred embodiment of the invention.
Figure 7:
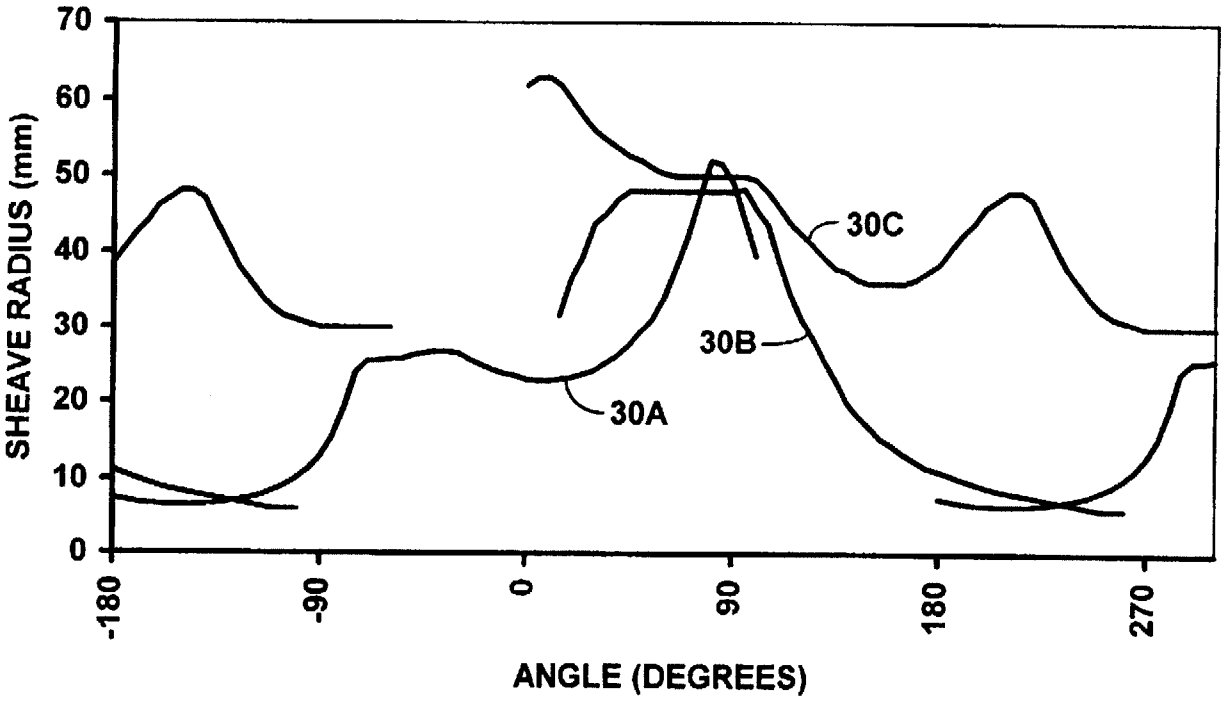
FIG. 7 is a Cartesian plot showing the shape of sheaves for a cam assembly according to a preferred embodiment of the invention.

The inventors consider that the cam shapes shown in FIGS. 6 and 7 and described in Table I are particularly advantageous for use in a bow 10. The angles given in these Figures and in Table I are angles around cam assembly 30 about axis 29 measured in degrees counterclockwise (when bow 10 is viewed with handle 20 facing right) from a line which joins axes 27 and 29 when bow 10 is not drawn. In this description, the frame of reference relative to which angle θ is measured rotates with cam assembly 30. The particular shapes shown are adapted for use in a bow 10 wherein the distance between axes 27 and 29 is about 36 to 38 inches.

Notable characteristics of the illustrated cam shapes are described below. Main sheave 30C is provided with a straight edge portion 90 originating from axis 29. Straight edge portion 90 preferably extends parallel to bowstring section 50B when bow 10 is not drawn and can be used to align cam assembly 30 when bow 10 is being set up. Straight edge portion 90 can be used to check that bow 10 is properly set up because straight edge portion 90 should point to axis 27 when bow 10 is not drawn.

Preferably, bow 10 is made to have "even tiller". Even tiller means that the perpendicular distance from bow string section 50B to one of limbs 22, 24 is the same as the perpendicular distance from bowstring section 50B to a corresponding point on the opposite one of limbs 22, 24. Even tiller is desirable because it is typically easier to aim a bow which has even tiller than it is to aim a bow which does not possess even tiller. Many single cam compound bows do not have even tiller. If limbs 22, 24 are symmetrical on handle 20, and axes 27, 29 are symmetrical on limbs 22, 24 then bow 10 will have even tiller if, when bow 10 is not drawn, bowstring section 50B lies parallel to a line joining axes 27 and 29. Under these conditions, even tiller can be accomplished by selecting pulley 26 and main cam 30C such that tangent point 55 is spaced behind axis 29 by a distance equal to the radius of pulley 26 when bow 10 is not drawn.

As noted above, the shape of cable sheave 30A largely determines the draw length of bow 10. As bow 10 is drawn tangent point 43 advances around cable sheave 30A in the direction of decreasing angle from its initial point at about 90 degrees. Cable sheave 30A has a region 94 of generally constant radius adjacent to a generally linear portion 96 which extends past axis 29. The angle $\theta_{start}$ of the point 98 at which linear portion 96 begins determines the angle of rotation of cam assembly 30 at which the let off of bow 10 begins. Let off can be delayed, thereby increasing draw length, by designing cable sheave 30A so that region 94 is longer ($\theta^{start}$ is a "smaller" angle). Conversely, making region 94 shorter so that tangent point reaches point 98 sooner will decrease the draw length of bow 10.

Linear portion 96 passes to within a few millimeters of axis 29 and continues for at least a short distance past axis 29. This continuation of linear portion 96 causes the force required to draw nock point 60 back farther than the draw length of bow 10 to increase suddenly to a level greater than the force required to hold nock 60 at the draw length. An archer using bow 10 can tell when maximum draw has been reached by felling this increase in force. The force required to hold nock point 60 at maximum draw can be varied by changing the minimum distance L at which linear portion 96 approaches axis 29. In general, increasing L increases the force.

Table 1

| angle (degrees) | main sheave radius (mm) | collector sheave radius (mm) | cable sheave radius (mm) |
|---|---|---|---|
| −180 | 38.5 | 11.2 | 7.5 |
| −175 | 40.5 | 10.7 | 7.2 |
| −170 | 42.5 | 10.1 | 6.9 |
| −165 | 44 | 9.6 | 6.7 |
| −160 | 46 | 9.1 | 6.6 |
| −155 | 47 | 8.7 | 6.5 |
| −150 | 48 | 8.4 | 6.5 |
| −145 | 48 | 8.1 | 6.5 |
| −140 | 47 | 7.8 | 6.6 |
| −135 | 44 | 7.5 | 6.7 |
| −130 | 41 | 7.2 | 6.9 |
| −125 | 38 | 6.9 | 7.2 |
| −120 | 36 | 6.6 | 7.5 |
| −115 | 34 | 6.3 | 7.9 |
| −110 | 32.5 | 6 | 8.5 |
| −105 | 31.5 | 6 | 9.2 |
| −100 | 31 | 6 | 10.1 |
| −95 | 30.5 | | 11.3 |
| −90 | 30 | | 13 |
| −85 | 30 | | 15.4 |
| −80 | 30 | | 19 |
| −75 | 30 | | 24 |
| −70 | 30 | | 25.4 |
| −65 | 30 | | 25.5 |
| −60 | 30 | | 25.7 |
| −55 | | | 25.7 |
| −50 | | | 26.2 |
| −45 | | | 26.5 |
| −40 | | | 26.7 |
| −35 | | | 26.7 |
| −30 | | | 26.5 |
| −25 | | | 25.7 |
| −20 | | | 25 |
| −15 | | | 24.3 |

Table 1-continued

| angle (degrees) | main sheave radius (mm) | collector sheave radius (mm) | cable sheave radius (mm) |
|---|---|---|---|
| −10 | | | 23.8 |
| −5 | | | 23.5 |
| 0 | 62 | | 23 |
| 5 | 63 | | 22.8 |
| 10 | 63 | | 22.8 |
| 15 | 62 | 31.7 | 23 |
| 20 | 60 | 36.4 | 23.2 |
| 25 | 57.8 | 39.4 | 23.7 |
| 30 | 56 | 43.7 | 24.2 |
| 35 | 54.8 | 45 | 25.2 |
| 40 | 53.7 | 46.9 | 26.2 |
| 45 | 52.6 | 48 | 27.7 |
| 50 | 52 | 48 | 29.5 |
| 55 | 51 | 48 | 31.2 |
| 60 | 50.3 | 48 | 34 |
| 65 | 50 | 48 | 38 |
| 70 | 50 | 48 | 42 |
| 75 | 50 | 48 | 47 |
| 80 | 50 | 48 | 52 |
| 85 | 50 | 48 | 51.6 |
| 90 | 50 | 48 | 49.2 |
| 95 | 50 | 48.3 | 44.4 |
| 100 | 49.5 | 45.75 | 39.6 |
| 105 | 48 | 43.8 | |
| 110 | 46 | 38.9784 | |
| 115 | 44 | 34.7416 | |
| 120 | 42.5 | 31.2528 | |
| 125 | 41 | 28.6608 | |
| 130 | 39.5 | 25.8 | |
| 135 | 38 | 23.1 | |
| 140 | 37.5 | 20.16 | |
| 145 | 36.5 | 18.404 | |
| 150 | 36 | 16.992 | |
| 155 | 36 | 15.42 | |
| 160 | 36 | 14.524 | |
| 165 | 36 | 13.384 | |
| 170 | 36.5 | 12.57 | |
| 175 | 37.5 | 11.688 | |
| 180 | 38.5 | 11.2 | 7.5 |
| 185 | 40.5 | 10.7 | 7.2 |
| 190 | 42.5 | 10.1 | 6.9 |
| 195 | 44 | 9.6 | 6.7 |
| 200 | 46 | 9.1 | 6.6 |
| 205 | 47 | 8.7 | 6.5 |
| 210 | 48 | 8.4 | 6.5 |
| 215 | 48 | 8.1 | 6.5 |
| 220 | 47 | 7.8 | 6.6 |
| 225 | 44 | 7.5 | 6.7 |
| 230 | 41 | 7.2 | 6.9 |
| 235 | 38 | 6.9 | 7.2 |
| 240 | 36 | 6.6 | 7.5 |
| 245 | 34 | 6.3 | 7.9 |
| 250 | 32.5 | 6 | 8.5 |
| 255 | 31.5 | 6 | 9.2 |
| 260 | 31 | 6 | 10.1 |
| 265 | 30.5 | | 11.3 |
| 270 | 30 | | 13 |
| 275 | 30 | | 15.4 |
| 280 | 30 | | 19 |
| 285 | 30 | | 24 |
| 290 | 30 | | 25.4 |
| 295 | 30 | | 25.5 |
| 300 | 30 | | 25.7 |
| 305 | | | 25.7 |
| 310 | | | 26.2 |
| 315 | | | 26.5 |
| 320 | | | 26.7 |
| 330 | | | 26.5 |
| 335 | | | 25.7 |
| 340 | | | 25 |
| 345 | | | 24.3 |
| 350 | | | 23.8 |
| 355 | | | 23.5 |

When bow 10 is fully drawn the tangent points 53 and 55 of the two ends of bowstring 50 are near the points where the radii of collector sheave 30B and main sheave 30C are maximum. Preferably at full draw these tangent points are within 20 degrees of the points at which sheaves 30B and 30C have their maximum radii. Most preferably at full draw these tangent points are within 5 degrees of the points at which sheaves 30B and 30C have their maximum radii.

Collector sheave 30B has a broad radius peak at an angle of about 60 degrees ±20 degrees or so. As bow 10 is drawn tangent point 43 reaches linear portion 96 of cable sheave 30A before tangent point 55 reaches the radius peak on collector sheave 30B.

Main sheave 30C has a local maximum (or 'chin') 100 at about 215 degrees±30 degrees. Tangent point 55 coincides with chin 100 within the first few inches of draw. Chin 100 functions to prevent nock point 60 from dropping too low in the last few inches of travel as bow 10 is released. This avoids a performance defect in some prior art bows.

From Table 1, it can be seen that collector sheave 30B has a larger radius than cable sheave 30A in the angular ranges 15° to 75° and 180° to 230°.

One disadvantage of prior art single cam bows is that they provide no convenient means for adjusting their draw lengths. In bow 10, cable sheave 30A is detachably mounted to cam assembly 30 so that cable sheaves which produce different draw lengths can be mounted in its place. The inventors have discovered that it is possible to effectively vary the draw length of a single cam bow 10 by changing the profile of cable sheave 30A while preserving desirable shooting characteristics of bow 10.

Figure 10:
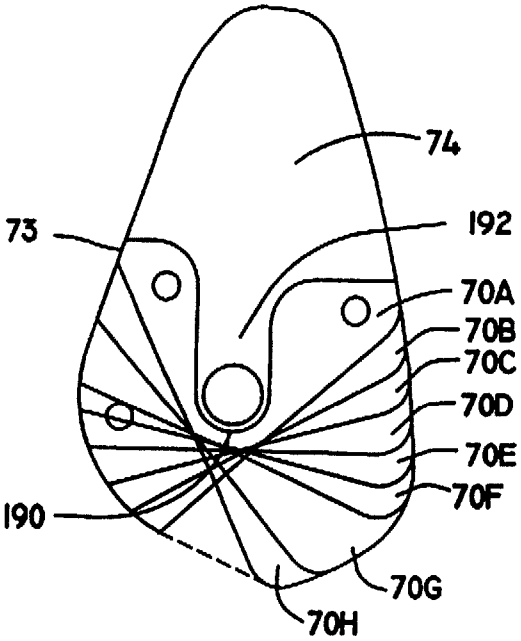
FIG. 10 is a schematic illustration showing the envelope for a series of cable sheaves.
Figure 11:
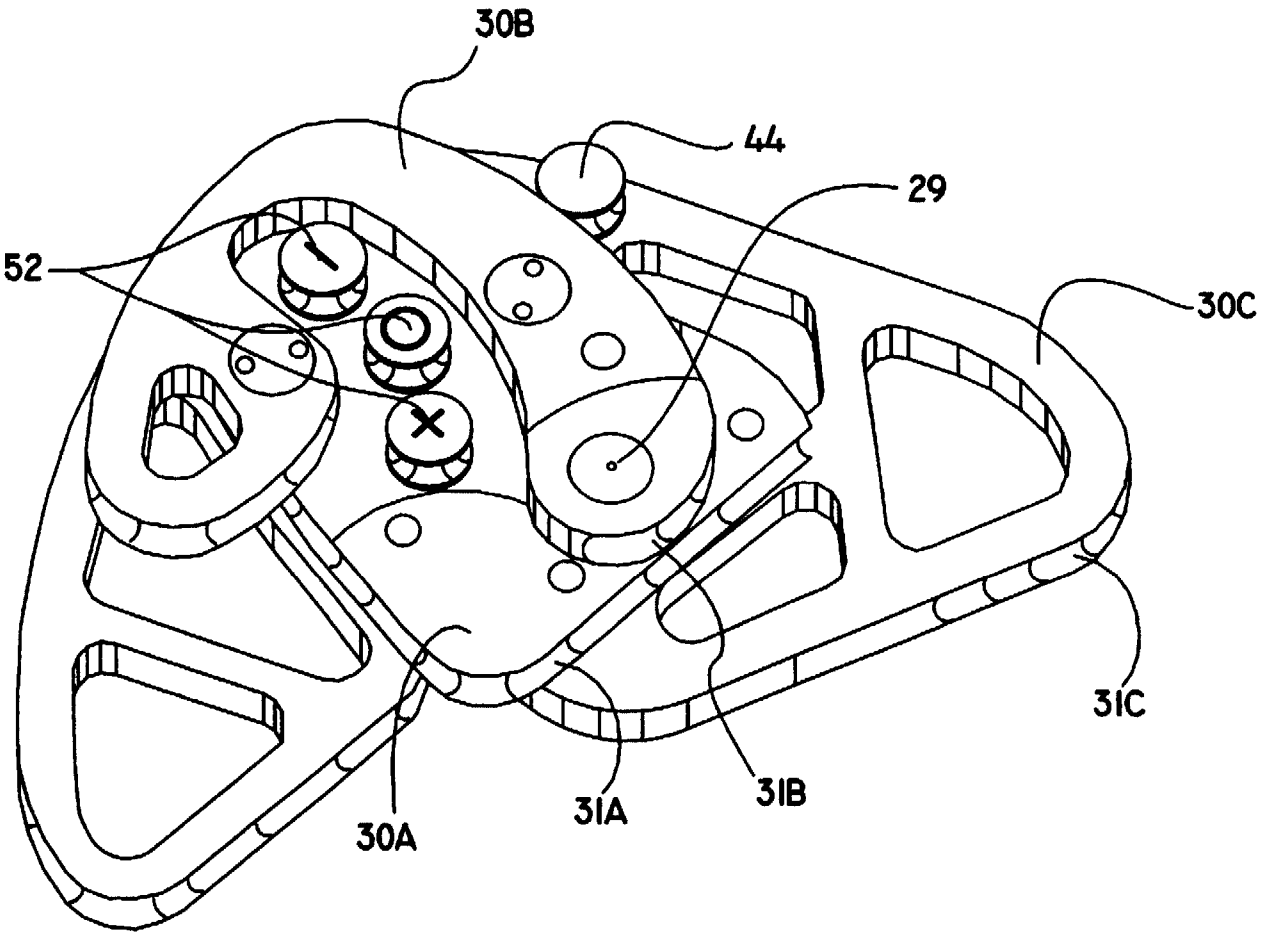
FIG. 11 is a perspective view of a cam assembly illustrating the relative orientations of sheaves in the cam assembly from the collector sheave side; and, FIG. 12 is a perspective view of the cam assembly of FIG. 11 illustrating the relative orientations of sheaves in the cam assembly from the main sheave side.
Figure 12:
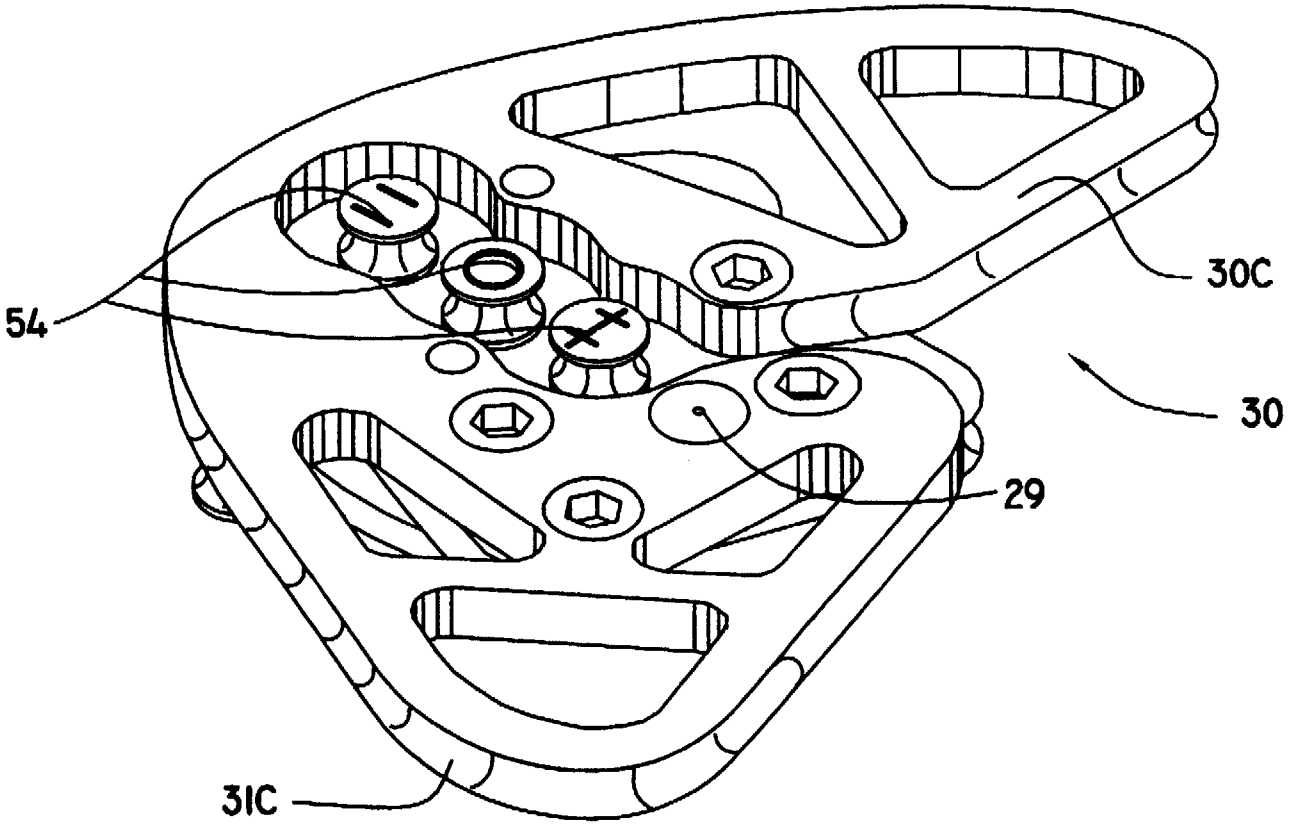

As shown in FIGS. 9A through 9D, the inventors have discovered that it is possible to provide a series of interchangeable cable sheave modules 70A, 70B, 70C, 70D which can be interchangeably mounted to cam assembly 30 to provide different profiles for cable sheave 30A to provide different draw lengths. Unexpectedly, the desired profile for cable sheave 30A has the same general shape for all draw lengths. FIG. 10 shows the profiles 72A through 72H of a number of cable sheaves for different draw lengths superimposed upon each other. It is apparent that all of the cable sheave profiles fall within the same envelope 73.

The difference between different ones of cable sheave profiles 72A through 72H lies primarily in the angular length of the constant radius region 94. Each cable sheave profile takes on the shape of the next larger one inside envelope 73 with the angle of point 98 at which linear section 96 begins increasing in each case. It would be possible to practise the invention by providing a series of interchangeable cable sheaves 30A having profiles varying generally as shown in FIG. 10.

Because the initial portions of all of cable sheave profiles 72A through 72H are essentially the same shape, the inventors have discovered that cable sheave 30A is preferably made in two parts: a non-interchangeable portion 74 which is used for all draw lengths and a series of interchangeable cable sheave modules referred to generally as 70. Non-interchangeable or "fixed" portion 74 is a relatively large portion of cable sheave 30A in which tangent point 43 is located in the early stages of drawing bow 10. As bow 10 is drawn, tangent point 43 traverses the periphery of fixed portion 74 through an angular range which is preferably about 40 degrees to about 60 degrees and is most preferably about 50 degrees.

Fixed portion 74 may be an integral portion of cam assembly 30. Fixed portion 74 of cable sheave 30A can provide support for main sheave 30C and cable sheave 30B while simultaneously providing a stable mounting place for cable sheave modules 70. Fixed portion 74 preferably has a thin wall 190 which surrounds the hole through which axle 28 passes. Wall 190 provides structural support and locates bushing(s) or bearings 191 which support cam assembly 30 around axle 28. Wall 190 is thin so that it allows the use of cable sheave modules 70 which have portions with very small radii as required to provide let-off as described above. Wall 190 is preferably in a generally U-shaped projection 192 extending from fixed portion 74. Cable sheave modules 70 have generally U-shaped indentations 193 which receive U-shaped projection 192.

FIGS. 9A through 9D show a series of cable sheave modules 70A, 70B, 70C, and 70D which are interchangeable to vary the profile of cable sheave 30A. The set of cable sheave modules illustrated in FIGS. 9A through 9D allow the draw length of bow 10 to be adjusted in increments, for example, in one inch increments.

Figure 4:
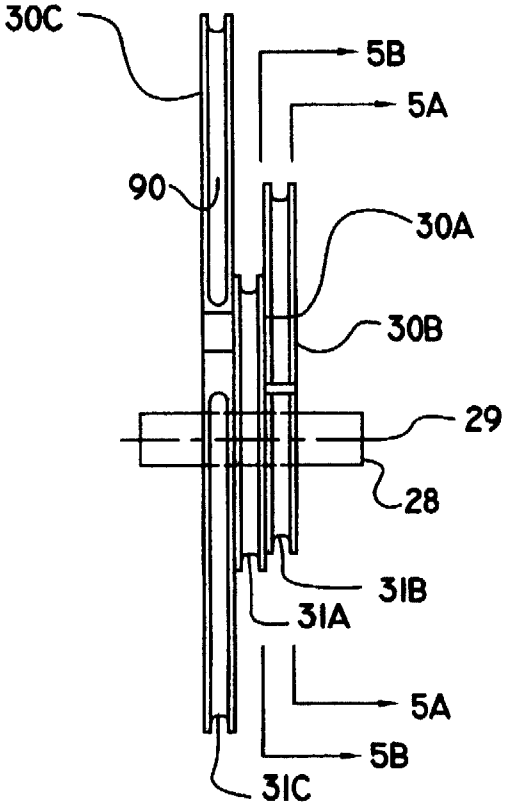
FIG. 4 is a side elevational exploded view of the cam assembly thereof.
Figure 3:
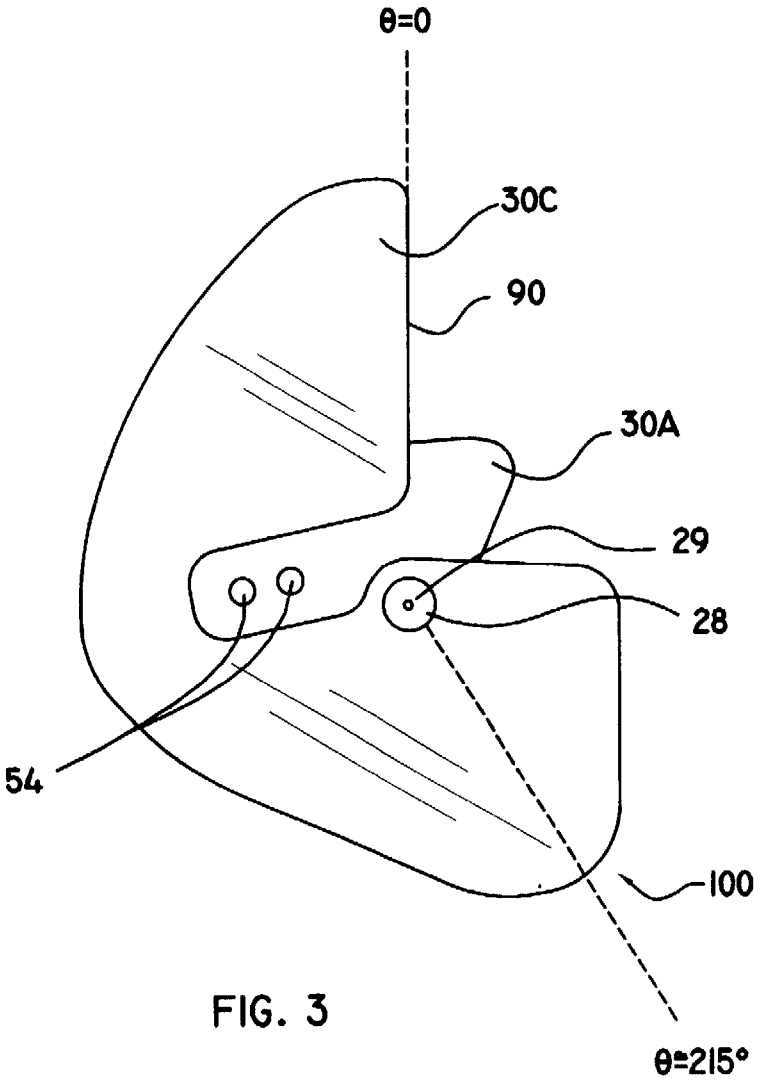
FIG. 3 is a rear elevational detailed view of the cam assembly thereof.
Figure 5B:
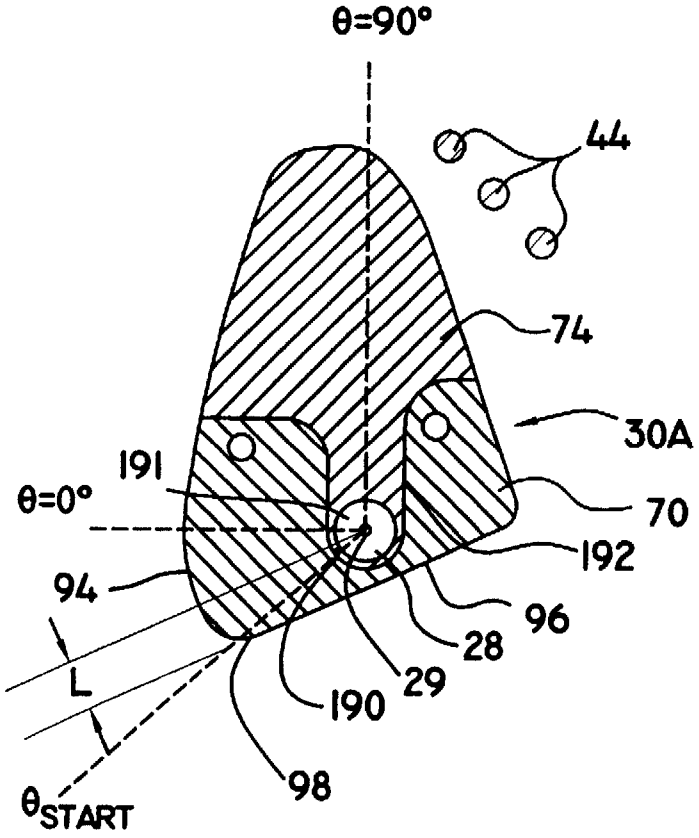
FIGS. 5A and 5B are sectional views on the lines 5A—5A, and 5B—5B of FIG. 4 respectively.
Figure 5A:
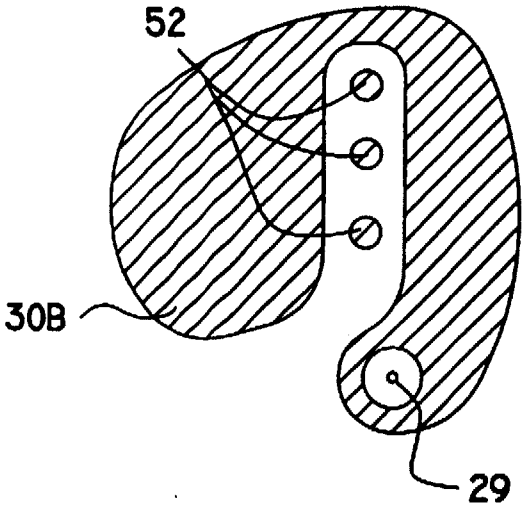

As shown in FIGS. 1, 4 and 5B cable sheave modules 70 are preferably held sandwiched between main sheave 30C and collector sheave 30B.

While it would be easier to place a modular cable sheave 30A on the outside of the cam assembly 30 there are advantages to placing the cable sheave 30A in the middle, as discussed above. Making cable sheave 30A in two parts, 70, 74 as discussed herein facilitates changing the draw length of bow 10 while bow 10 is strung. This would otherwise be difficult or impossible to do, especially with cable sheave 30A in the middle of cam assembly 30, without special bow compressing equipment which is normally found only in archery shops.

A preferred construction for cam assembly 30 is to have at least part of the collector sheave 30B made as a separate component and attached to a part which combines main sheave 30C and the fixed portion 74 of cable sheave 30A. Preferably, whatever fasteners are used to fasten collector sheave 30B to cam assembly 30 are different from, and are on a different side of cam assembly 30 from the fasteners used to fasten cable sheave modules 70 to cam assembly 30. This lessens the likelihood that a user will inadvertently dismantle collector sheave 30B from cam assembly 30. It would be difficult for a user to replace collector sheave 30B without special tools. Cable sheave modules 70 can be interchanged without removing the rest of cam assembly 30 from bow 10.

Cable sheave modules 70 are subjected to very large forces as bow 10 is drawn and released. Consequently cable sheave modules 70 must be attached to the rest of cam assembly 30 by strong attachment means such as bolts, bolts combined with pins projecting from and/or into cable sheave modules 70 or some other suitably strong fastening means. Preferably interchangeable cable sheave modules 70 of cable sheave 30A are fastened between sheaves 30B and 30C with fasteners, such as screws or pins, that pass through one or both of sheaves 30B and 30C and into the cable sheave module 70 which is in place on cam assembly 30.

Preferably cable sheave module 70 can be removed while bow 10 is strung. As there is considerable tension on cable 40, even when bow 10 is not drawn, cable 40 passes around a portion of groove 31A in fixed portion 74 before it passes around the portion of groove 31A which extends around the periphery of cable sheave module 70 of cable sheave 30A. When bow 10 is not drawn then tangent point 43 is on fixed portion 74 and cable 40 does not engage the portion of groove 31A in cable sheave module 70. Fixed portion 74 is preferably attached to either or both of collector sheave 30B and main sheave 30C.

The structure described above permits the draw length of bow 10 to be adjusted in relatively coarse increments. Fine adjustment of the draw length of bow 10 is preferably accomplished by altering the positions of one or both of attachment points 52 and 54. Attachment points 52 and 54 may comprise, for example, a series of spaced apart fixed posts or movable posts comprising, for example, grooved sleeves held in place by bolts threaded into holes 80 in cam assembly 30. A loop at the end of bowstring 50 can then be looped over the sleeve. Several holes 80 may be provided for each of attachment points 52 and 54. Providing several posts or hooks (not shown) to permit the draw length of bow 10 to be adjusted by looping the end of bowstring 50 over a different post or hook has the advantage of requiring fewer separate parts than providing movable posts. However, fixed posts may need to be spaced apart farther than the holes 80 described above so that adjacent posts do not obstruct bowstring 50 from being placed on a desired post. Other means for adjustably affixing the ends of bowstring 50 to cam assembly 30 also come within the broad scope of the invention.

Preferably the alternative positions for attachment point 52 are spaced so that the draw length of bowstring 50 can be adjusted in increments of a first size, for example, ½ inches and the alternative positions for attachment point 54 are spaced so that the draw length of bowstring 50 can be adjusted in increments of a second size, for example, ⅓ inches. By moving both of attachment points 52 and 54 the draw length of bow 10 can then be adjusted in ⅙ inch increments.

By providing a bow 10, as described above, together with a set of several interchangeable cable sheaves 30A the draw length of bow 10 can be adjusted in small increments, for example ⅙ inch increments, over a range of several inches.

The invention may be packaged in the form of a kit comprising a collection of interchangeable cable sheave modules 70 and a cam assembly 30 for receiving cable sheave modules 70 as described above.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A compound bow comprising:

(a) a handle;

(b) opposed upper and lower flexible limbs having inner ends connected to the handle;

(c) a cam assembly pivotally mounted at an outer end of one of the limbs for rotation about a first axis, the cam assembly having:

(1) a main sheave (2) a collector sheave parallel to the main sheave; and, (3) a cable sheave between and parallel to the main and collector sheaves, the cable sheave having a removable portion and a non-interchangeable portion, each of the sheaves having a profile;

(d) a pulley pivotally mounted at an outer end of a second one of the limbs for rotation about a second axis;

(e) a bowstring having a first segment extending from a first attachment point on the cam assembly, around a peripheral portion of the collector sheave, and around the pulley, and a second segment extending from the pulley, around a peripheral portion of the main sheave to a second attachment point on the cam assembly; and (f) a cable extending from an attachment point near the outer end of the second one of the limbs around a peripheral portion of the non-interchangeable portion of the cable sheave to a third attachment point on the cam assembly.

2. The compound bow of claim 1 wherein the cable extends from the cable sheave to the third attachment point and length of the cable between the third attachment point and the cable sheave is adjustable.

3. The compound bow of claim 1 wherein, as said bow is drawn, a tangent point at which said cable leaves said cable sheave traverses an angle of at least 40 degrees relative to said first axis around said non-interchangeable portion of said cable sheave before said tangent point passes onto said removable portion of said cable sheave.

4. The compound bow of claim 3 wherein the cable sheave is pivotally mounted to an axle passing through the non-interchangeable portion of the cable sheave.

5. The compound bow of claim 4 wherein the cam assembly comprises first fasteners passing through the first bowstring sheave, the removable portion of the cable sheave and into the second bowstring sheave.

6. The compound bow of claim 5 wherein the cam assembly comprises second fasteners fastening the main sheave, the collector sheave and the non-interchangeable portion of the cable sheave together and the second fasteners are removable only from one side of the cam assembly and the first fasteners are removable only from a side of the cam assembly opposite to the one side.

7. The compound bow of claim 1 wherein the main sheave profile comprises a straight segment, the straight segment extending parallel to the second segment of the bowstring when the bow is not drawn.

8. The compound bow of claim 7 wherein the straight segment of the main sheave extends radially relative to the first axis.

9. The compound bow of claim 8 wherein the second segment of the bowstring is parallel to a line joining the first and second axes when the bow is not drawn.

10. The compound bow of claim 1 wherein the first bowstring sheave has a chin area comprising an area of increased radius located at an angle $\theta$ of 215 degrees $\pm 30$ degrees relative to the first axis, where $\theta$ is measured counterclockwise when the bow is viewed with the handle facing right from a line which joins the first and second axes when the bow is not drawn.

11. The compound bow of claim 10 wherein the collector and main sheaves have radii which vary with angle $\theta$ in a way which deviates by 5% or less from the values set out in Table I.

12. The compound bow of claim 11 wherein the cable sheave has a radius which varies with angle in a way which deviates by 5% or less from the values set out in Table I.

13. A compound bow kit comprising:

(a) a handle;

(b) upper and lower flexible limbs having inner ends connected to opposite ends of the handle;

(c) a cam assembly pivotally mounted at an outer end of one of the limbs for rotation about a first axis, the cam assembly having:

(1) a main sheave (2) a collector sheave parallel to the main sheave; and, (3) a cable sheave between and parallel to the main and collector sheaves, the cable sheave having a nonremovable portion;

(d) a set consisting of a plurality of removable cable sheave modules in graduated sizes, each of the cable sheave modules capable of rigid attachment to the cam assembly between the main and collector sheaves adjacent the non-interchangeable portion of the cable sheave while the bow is strung; wherein a draw length of the bow is adjustable to one of a plurality of fixed draw lengths by selecting and attaching one of the plurality of removable cable sheave modules to the cam assembly;

(e) a pulley pivotally mounted at an outer end of a second one of the limbs;

(f) a bow string extending from a first attachment means on the cam assembly, around a peripheral portion of the collector bow string sheave, around the pulley, and around a peripheral portion of the main bow string sheave to a second attachment means on the cam assembly, the second attachment means having two or more alternative positions spaced at increments of a first length wherein the draw length of the bow is adjustable to draw lengths intermediate two of the plurality of fixed draw lengths by selecting one of the alterative positions for the second attachment means; and (f) a cable extending from an attachment point near the outer end of the second one of the limbs around a peripheral portion of the non-interchangeable portion of the cable sheave to a third attachment means on the cam assembly.

14. The compound bow kit of claim 13 wherein said first attachment means has two or more alternative positions spaced at increments of a second length wherein the draw length of the bow is finely adjustable to draw lengths intermediate two of the plurality of fixed draw lengths by selecting one of the alternative positions for each of the first and second attachment means.

15. The compound bow kit of claim 14 wherein the first and second attachment means each comprise a plurality of fixed spaced apart posts.

16. The compound bow kit of claim 15 wherein the cable extends from a point on the cable sheave to the third attachment means and a distance between the third attachment means and the point on the cable sheave is adjustable.

17. The compound bow kit of claim 14 wherein the second attachment means comprises a pin engagable in one of a plurality of holes.

18. A cam assembly for a single cam compound bow, the cam assembly comprising:

(a) a fixed portion of a cable sheave mounted between a collector sheave and a main sheave;

(b) an interchangeable cable sheave module mounted between the collector sheave and the main sheave adjacent the cable sheave fixed portion;

(c) fasteners passing through the cable sheave module, the fasteners extending into the main sheave and collector sheave on either side of the cable sheave module;

(d) an axle passing through the cam assembly.

19. The cam assembly of claim 18 wherein the axle passes through the cable sheave fixed portion.

20. The cam assembly of claim 19 wherein said cable sheave fixed portion comprises a generally U-shaped projection, said axle passes through said projection and said cable sheave module comprises a corresponding U-shaped indentation which receives the U-shaped projection.

21. The cam assembly of claim 20 wherein the cable sheave fixed portion has a radius relative to a center point of the axle which is smaller than a corresponding radius of the main sheave at all angles.

22. The cam assembly of claim 20 wherein the collector and main sheaves have radii which vary with angle in a way which deviates by less than 5% from the values set out in Table I.

23. The cam assembly of claim 22 wherein the cable sheave fixed portion and the cable sheave module together have a profile, the profile having a radius which varies with angle in a way which deviates by no more than 5% from the values set out in Table I.

* * * * *